US007814962B2

(12) United States Patent
You et al.

(10) Patent No.: US 7,814,962 B2
(45) Date of Patent: Oct. 19, 2010

(54) APPARATUS FOR HORIZONTAL CONTINUOUS CASTING OF MAGNESIUM ALLOYS PLATE AND MANUFACTURING METHOD THEREOF

(75) Inventors: Bong-Sun You, Kyungsangnam-do (KR); Ha-Sik Kim, Kyungsangnam-do (KR); Chang-Dong Yim, Kyungsangnam-do (KR); Beom-Sik Kam, Kyungsangnam-do (KR)

(73) Assignee: Korea Institute of Machinery and Materials, Daejeon (KR)

( * ) Notice: Subject to any disclaimer, the term of this patent is extended or adjusted under 35 U.S.C. 154(b) by 182 days.

(21) Appl. No.: 11/666,536

(22) PCT Filed: Nov. 19, 2004

(86) PCT No.: PCT/KR2004/003009

§ 371 (c)(1),
(2), (4) Date: Apr. 27, 2007

(87) PCT Pub. No.: WO2006/049365

PCT Pub. Date: May 11, 2006

(65) Prior Publication Data

US 2007/0284075 A1 Dec. 13, 2007

(30) Foreign Application Priority Data

Nov. 4, 2004 (KR) ..... 10-2004-0089242

(51) Int. Cl.
*B22D 11/00* (2006.01)

(52) U.S. Cl. ..... 164/490; 164/335; 164/338.1; 164/355; 164/415

(58) Field of Classification Search ..... 164/490, 164/335, 338.1, 355, 415
See application file for complete search history.

(56) References Cited

U.S. PATENT DOCUMENTS 3,163,895 A * 1/1965 Dewey ..... 164/451
4,009,749 A * 3/1977 Alberny ..... 164/504
4,501,317 A 2/1985 Sokolowski (Continued)

FOREIGN PATENT DOCUMENTS

JP 60087956 5/1985
JP 04197555 7/1992

OTHER PUBLICATIONS

English language abstract of Japan Patent Publication No. JP 04 197555 published Jul. 17, 1992.

(Continued)

*Primary Examiner*—Jessica L Ward
*Assistant Examiner*—Nicholas P D'Aniello
(74) *Attorney, Agent, or Firm*—Cooper & Dunham LLP

(57) ABSTRACT

A horizontal continuous casting apparatus for continuously manufacturing a magnesium alloy plate and a method of manufacturing a magnesium alloy plate using the same. The horizontal continuous casting apparatus is structured such that the cross-sectional area of the plate is equal to or smaller than that of a melt inlet, and includes a cooling unit for indirectly cooling the melt using a cooling jacket provided to the outer wall of the mold and/or for directly cooling the melt through spraying of cooling water, and a drawing unit having a multi-step drawing cycle. Thereby, magnesium alloy plates having various sizes can be safely and continuously cast.

1 Claim, 3 Drawing Sheets

U.S. PATENT DOCUMENTS 4,540,037 A 9/1985 Langner
4,653,570 A * 3/1987 Stonecliffe et al. ..... 164/440
4,960,163 A 10/1990 Fang et al.
6,589,474 B1 * 7/2003 Bae et al. ..... 266/229
2003/0159797 A1 * 8/2003 Yamasaki et al. ..... 164/490

OTHER PUBLICATIONS

English language abstract of Japan Patent Publication No. JP 60 087956 published May 17, 1985.

* cited by examiner

【Fig. 1】
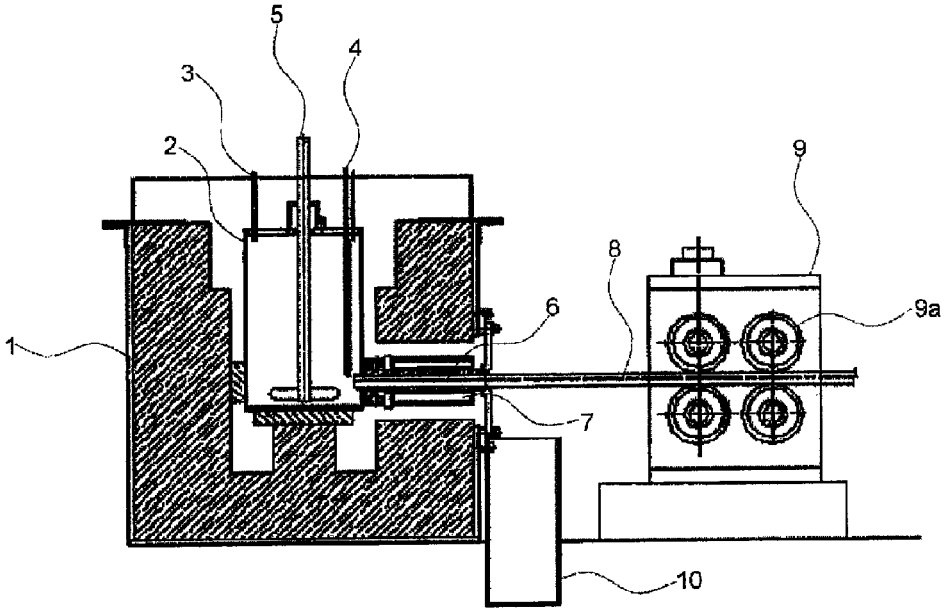
【Fig. 2】
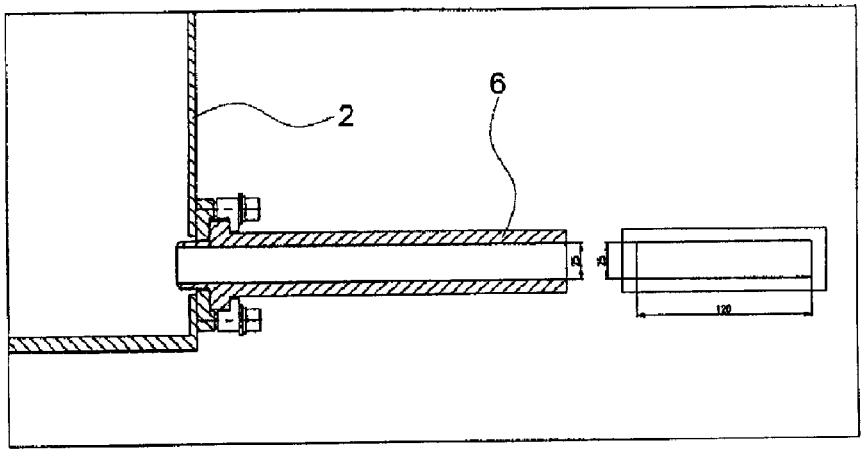

【Fig. 3】
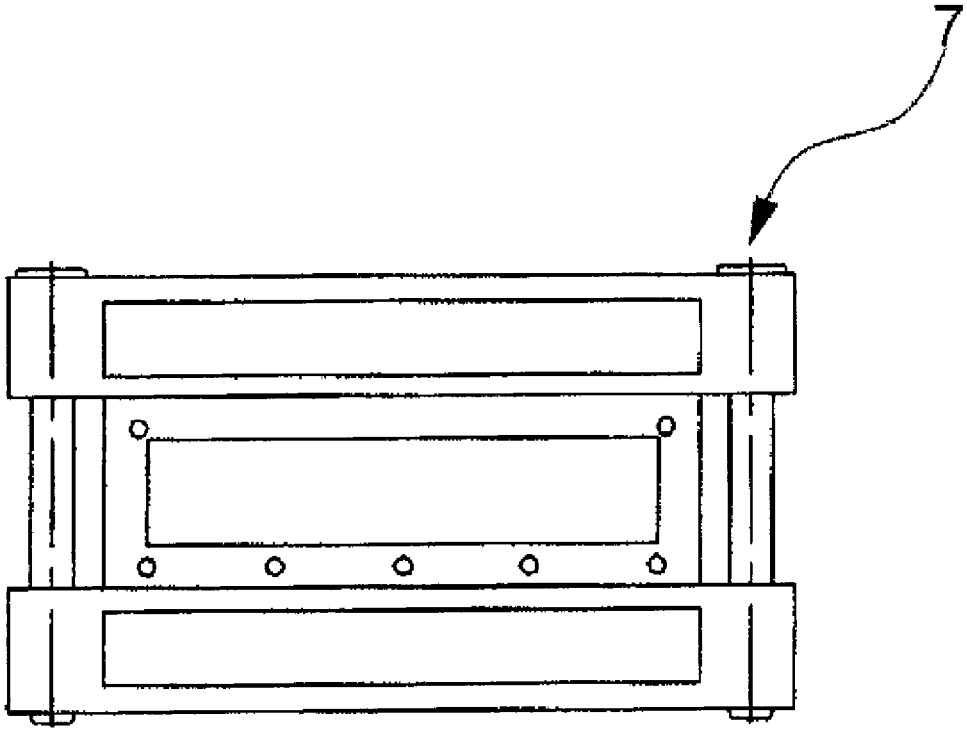

[Fig. 4]
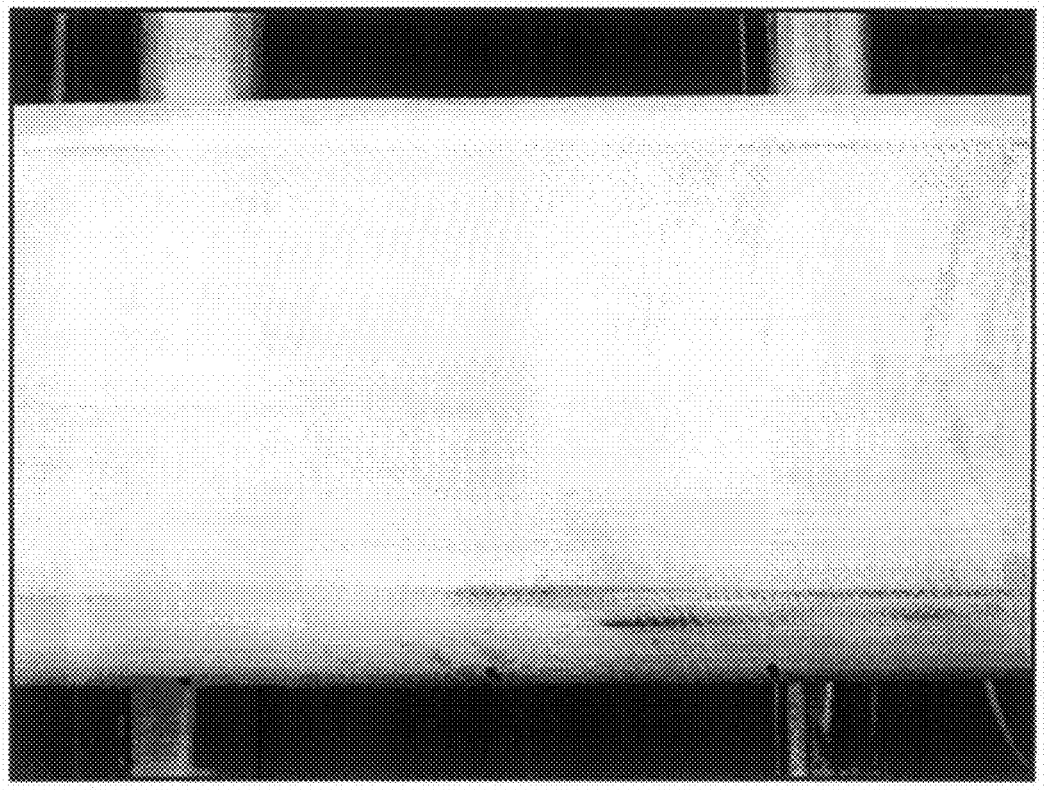

APPARATUS FOR HORIZONTAL CONTINUOUS CASTING OF MAGNESIUM ALLOYS PLATE AND MANUFACTURING METHOD THEREOF

TECHNICAL FIELD

The present invention relates, in general, to a horizontal continuous casting apparatus for continuous casting of a magnesium alloy plate and a method of manufacturing a magnesium alloy plate using the same. More particularly, the present invention relates to an apparatus for continuously casting a magnesium alloy plate having a cross-sectional area equal to or smaller than a melt inlet and a method of manufacturing a magnesium alloy plate using the same.

BACKGROUND ART

Of commercially available structural materials, magnesium alloys have the smallest density and excellent specific strength and specific stiffness, and thus has been widely applied not only to parts of aircraft or automobiles, but also to parts of electronics or leisure products. Presently, almost all the magnesium alloy products have been manufactured mainly by die-casting process. However, with the demand for magnesium alloy products having various shapes and excellent properties is drastically increased, the development of new techniques for manufacturing semi-product or final product using a plastic working process, such as extruding, rolling, sheet forming, forging, etc., has been studied in recent years.

As for the casting process, an alloy is melted, supplied into a mold having a predetermined shape and then solidified to a desired product. On the other hand, in case of wrought alloy, an intermediate material, such as a billet, a slab or a plate, is prepared and plastically deformed into semi or final product. Examples of techniques for preparing an intermediate material for a plastic working process include, but are not limited to, a method of preparing a billet or slab in a batch type casting, a vertical continuous casting method for supplying a melt into a vertically disposed mold and solidifying the melt, and a horizontal continuous casting method for supplying a melt into a horizontally disposed mold and solidifying the melt.

However, the method of preparing a billet or slab in a batch type suffers because surface defects occur due to solidification shrinkage, segregation and microstructural non-uniform. Further, the properties of the intermediate material are not good and the melt loss are high. Furthermore, the productivity is decreased.

Meanwhile, in case of the vertical continuous casting method, it is difficult to prepare intermediate materials having various shapes and small cross-section area. In addition, the vertical continuous casting method is a semi-continuous casting process. Thus, the casting process should be interrupted after it has predetermined length. In contrast, the horizontal continuous casting process is advantageous because an intermediate material having good quality can be continuously prepared, and products having various shapes, such as plate-, rod- or pipe-shapes, may be easily prepared.

Although the horizontal continuous casting technique may be commercially applied to an aluminum alloy and a copper alloy, such a technique is difficult to actually apply to a magnesium alloy due to relatively lower flowability and higher reactivity with oxygen of the magnesium alloy, compared to those of the aluminum or copper alloy. In particular, when the magnesium alloy melt comes into contact with water, a sudden explosion may occur. Therefore, a continuous casting process must be developed in consideration of safety hazards.

In this regard, a horizontal continuous apparatus (U.S. Pat. No. 5,915,455), developed by Norsk Hydro, has been proposed, in which magnesium is melted in a melting furnace, fed into a holding furnace and then supplied into a mold through a melt inlet positioned at the lower portion of the holding furnace, and solidified to billet by cooling system. The horizontal continuous apparatus is suitable for the preparation of a billet or slab in which the cross-sectional area of a cast material is larger than that of the melt inlet. Further, in order to cool the melt, the cooling process, including an indirect first-cooling and direct second-cooling process has been adopted.

However, the direct cooling process used to increase the casting speed is disadvantageous because the cooling water sprayed onto the surface of the billet flows backward into the mold along the surface of the billet and thus may undesirably react with the magnesium alloy melt, or the splashed melt may react with the cooling water in the water bath, therefore sudden explosions may be generated. In practice, such accidents have been reported.

BRIEF DESCRIPTION OF DRAWINGS

FIG. 1 is a schematic view showing the whole structure of an apparatus for manufacturing a magnesium alloy plate through horizontal continuous casting, according to the present invention;

FIG. 2 is a cross-sectional view showing a mold for the preparation of magnesium alloy plate;

FIG. 3 is a front view showing an indirect cooling jacket around the mold for the preparation of the magnesium alloy plate; and FIG. 4 is a view showing the external appearance of a horizontally continuously cast AZ31 magnesium alloy plate.

DISCLOSURE OF THE INVENTION

Technical Tasks to be Solved by the Invention

Accordingly, the present invention has been devised to solve the problems of vertical continuous casting mentioned as above and economically prepare an intermediate material, and an object of the present invention is to provide a horizontal continuous casting apparatus, in which not only a direct cooling water spraying process but also an indirect water cooling process using a cooling jacket is applied to continuous casting of a magnesium plate having a cross-sectional area equal to or smaller than that of a melt inlet, in order to continuously cast a plate having a small cross-sectional area, and thereby magnesium alloy plates having various sizes can be safely continuously cast.

Another object of the present invention is to provide a method of manufacturing a magnesium alloy plate using such an apparatus.

Technical Solution

In order to accomplish the above objects, the present invention provides an apparatus for horizontal continuous casting of a magnesium alloy plate, comprising a sealed melting furnace and holding furnace having a crucible into which a magnesium ingot is loaded to be heated and melted; a mold in a plate form, which is directly or indirectly connected to the crucible in the holding furnace; a dummy bar inserted into the mold; a cooling unit for cooling a magnesium alloy melt supplied into the mold; and a drawing unit for drawing a continuously cast material having a predetermined shape, processed through the mold, using a driving motor.

In addition, the apparatus of the present invention is characterized by further comprising a gas inlet pipe to feed a protective gas for protection of the magnesium alloy melt; a thermocouples to measure the temperature of the melt in the crucible; and an impeller to purify the melt in the crucible and uniformly control the temperature of the melt.

In addition, the apparatus of the present invention is characterized in that the cooling unit comprises a cooling jacket attached to an outer wall of the mold.

In addition, the apparatus of the present invention is characterized in that the drawing unit comprises upper and lower drawing rolls, between which the continuously cast material passes, the driving motor for driving the drawing rolls, and an automatic control system for controlling the drawing rolls.

Further, the present invention provides a method of manufacturing a magnesium alloy plate through horizontal continuous casting, comprising loading a magnesium alloy into a crucible of a melting and holding furnace, heating and melting the magnesium alloy to its melting point or higher to prepare a magnesium alloy melt, and uniformly controlling a temperature of the magnesium alloy melt using an impeller; cooling the magnesium alloy melt by indirect and/or direct cooling system, while supplying the melt into the mold to contact a dummy bar inserted into the mold so as to solidify the melt in the same plate size as an internal shape of the mold; and continuously drawing a magnesium alloy plate solidified in the mold through movement of the dummy bar using a drawing unit.

In addition, the method of the present invention is characterized in that the continuously drawing of the magnesium alloy plate is conducted by using a two-step drawing cycle including a forward and stop, a three-step drawing cycle including a forward, stop and a backward motion, or a four-step drawing cycle including a forward, stop, a backward motion and stop.

In addition, the apparatus of the present invention is characterized in that the continuously drawing of the magnesium alloy plate is conducted through automatic operation of the two-step drawing cycle, the three-step drawing cycle, or the four-step drawing cycle using the automatic control system.

Hereinafter, a detailed description will be given of the present invention, with reference to the appended drawings.

FIG. 1 is a view schematically showing the whole structure of an apparatus for manufacturing a magnesium alloy plate through horizontal continuous casting, according to the present invention. As shown in this drawing, the apparatus of the present invention comprises a separate melting furnace (not shown), a holding furnace 1, a mold 6 extended to the holding furnace and crucible. A dummy bar 8 inserted longitudinally into the center of the mold, cooling units 7 disposed at upper and lower sides of the mold, and a drawing unit 9 provided from near the holding furnace for drawing a plate, which is continuously cast through the mold extended to outside the holding furnace. The drawing unit includes two pairs of upper and lower drawing rolls 9*a* positioned above and below the plate. Further, a discharge chamber 10 is attached to the outer side surface of the holding furnace below the externally extended mold.

The holding furnace 1 may be manufactured in the form of an electrical furnace using a heating body such as a heater or of an induction furnace, in which a crucible 2 formed of steel without Ni is included. The crucible is provided in a sealed form to suppress a reaction of the magnesium melt to air.

A gas inlet pipe 3 is extended from a predetermined portion of the upper end of the holding furnace 1 to the crucible 2 so as to feed a protective gas for the protection of the melt. Hence, the oxidation and ignition of the magnesium alloy melt may be prevented by the protective gas fed through the gas inlet pipe.

A thermocouple thermometer 4 is vertically extended from another portion of the upper end of the holding furnace 1 to the inner portion of the crucible 2 so as to continuously measure the temperature of the magnesium alloy melt in the crucible.

An impeller 5 is vertically extended from the upper end of the holding furnace 1 to the bottom of the crucible 2 to purify the melt. That is, the impeller is rotated at a certain speed to form gas bubbles such that impurities in the melt are removed and the temperature of the magnesium alloy melt in the crucible is uniformly controlled. As such, gas used to form the gas bubbles preferably includes an inert gas, such as argon (Ar) gas.

The side surface of the lower end of the crucible 2 is connected to one end of the mold 6 extended to outside the holding furnace to continuously cast the magnesium alloy plate. The connection portion between the crucible 2 and the mold 6 is covered with a heat-insulating material, so as to be completely sealed.

FIG. 2 is a cross-sectional view schematically showing the mold for the preparation of magnesium plate. As shown in this drawing, the cross-section of the mold 6, connected to the crucible 2 of the holding furnace to continuously cast the magnesium alloy plate, is formed in a plate shape by the shape of the product to be cast. Particularly, with the goal of manufacturing a desired plate, the mold 6 is designed such that the cross-sectional area of the plate to be solidified in the mold 6 is equal to or smaller than that of the melt inlet of the crucible 2 made of steel.

In the case where the cross-sectional area of the plate to be continuously cast is larger than that of the melt inlet, since the solidification point of the melt may be sufficiently predicted due to the application of the heat-insulating material, a mold 6 may be formed of metal such as steel, a copper alloy, etc. However, as in the present invention, where the cross-sectional area of the mold 6 is smaller than or equal to that of the melt inlet, a mold 6 formed of non-metal such as graphite or BN (boron nitride) is used.

The magnesium alloy, melted in the crucible 2 in the holding furnace 1, is supplied into the mold 6, contacts the dummy bar 8 inserted into the mold, and is then solidified according to the internal shape of the mold by the cooling units 7 and/or secondly cooling water (not shown).

FIG. 3 is a front view schematically showing a cooling jacket around the mold for the preparation of the plate. As shown in this drawing, the cooling unit 7 consists of the cooling jacket surrounding the outer wall of the mold 6 such that cooling water at an appropriate temperature is circulated in the jacket to indirectly cool the magnesium alloy melt in the mold 6.

Unlike aluminum alloys, the magnesium alloy actively reacts with water to emit a large amount of hydrogen, thus causing an explosion. Thus, a process of indirectly cooling a magnesium alloy melt with water using a cooling unit 7 is preferable in terms of safety hazard, rather than a process of directly cooling such a melt with water. Direct cooling as a secondly cooling can be applied after surface solidification of magnesium plate apart from the mold.

When the melt supplied into the mold 6 is solidified through the contact with the dummy bar 8 inserted into the mold, the solidified plate is joined to the dummy bar 8, and the solidified plate moves along the dummy bar 8 moving outside the mold using the drawing unit 9 as it is connected to the dummy bar, thereby obtaining a continuously cast plate having a predetermined shape.

The drawing unit 9 is composed of two pairs of upper and lower drawing rolls 9*a* which are disposed side by side, a control system, and a driving motor (not shown) for operating the drawing rolls. While the dummy bar 8 moves through the rotation of the two pairs of drawing rolls, depending on the operation of the driving motor, the continuously cast plate is drawn.

The drawing speed of the continuously cast plate is controlled, whereby the magnesium alloy melt is drawn in a state of being partially or completely solidified in the mold 6. Moreover, in order to prevent the disconnection of the plate and continuously manufacture a plate having excellent surface quality, a two-step drawing cycle including a forward and stop, a three-step drawing cycle including a forward, stop and a backward, or a four-step drawing cycle including a forward, stop, a backward and stop is applied. Such two-step to four-step drawing cycles may be automatically proceeded through the control system connected to the driving motor.

In cases where the disconnection of the magnesium alloy plate is caused due to the unstable solidification of the magnesium alloy melt in the mold 6, or where such disconnection occurs during the drawing process attributable to an unstable drawing cycle, the melt remaining in the mold is discharged into the discharge chamber 10 disposed outside the holding furnace 1 and is then safely solidified.

Advantageous Effects

The present invention provides an apparatus for horizontal continuous casting of a magnesium alloy plate and a method of manufacturing a magnesium alloy plate using the same. According to the present invention, the magnesium alloy plate having a cross-sectional area equal to or smaller than that of a melt inlet is continuously cast using the horizontal continuous casting apparatus. Thereby, conventional processes of casting a billet or slab having a large cross-sectional area and then extruding or rolling it may be omitted, thus exhibiting energy saving effects.

In addition, an indirect and/or direct cooling process is adopted, and thus, the stability of the process is increased. Further, a multi-step drawing system is applied, therefore stably manufacturing a continuously cast plate having good quality, resulting in increased productivity.

BEST MODE FOR CARRYING OUT THE INVENTION

A better understanding of the present invention may be obtained through the following example which is set forth to illustrate, but is not to be construed as the limit of the present invention.

Example 1

An AZ31 alloy (Mg-3Al-1Zn), serving as a typical wrought magnesium alloy, was heated to its melting point or higher to prepare a magnesium alloy melt, which was then supplied into a mold 6 having a plate form of a width of 120 mm and a thickness of 30 mm. Subsequently, the melt came into contact with a dummy bar 8 inserted into the mold and was then solidified in the same form as the cross-section of the mold.

As such, the magnesium alloy melt in the crubicle 2 was heated to 700° C., suitable for continuous casting, the temperature of which was controlled while refining the melt through the rotation of an impeller 5. The continuously cast plate was drawn at a drawing speed of 50 mm/min or more according to four-step drawing cycle using a drawing unit 9, thereby obtaining a continuously cast magnesium alloy plate having excellent surface quality without surface defects as shown in FIG. 4.

The invention claimed is:

1. An apparatus for horizontal continuous casting of a magnesium alloy plate, comprising:

a holding furnace having an upper end covering: (1) a crucible which is separately sealed and in which a magnesium alloy is heated and purified and (2) a cooling unit only disposed at upper and lower sides of a mold comprising a cooling jacket attached to an outer wall of the mold for indirectly cooling a magnesium alloy melt supplied into the mold by circulating a cooling water in the jacket, the mold being in a plate form and connected to the crucible in the holding furnace and having an internal cross-sectional area smaller than a melt inlet;

a dummy bar inserted into the mold;

a drawing unit for drawing a continuously cast material having a predetermined shape, processed through the mold, comprising upper and lower drawing rolls, a driving motor for driving the drawing rolls, and an automatic control system for controlling the drawing rolls;

a gas inlet pipe extended from a predetermined portion of the upper end of the holding furnace into the crucible to feed a protective gas for protection of the magnesium alloy melt;

a thermocouple thermometer vertically extended from the upper end of the holding furnace into the crucible to measure the temperature of the melt in the crucible;

an impeller extended to a central portion of the crucible to purify the melt in the crucible and uniformly control the temperature of the melt; and a discharge chamber directly attached to the outer side surface of the holding furnace below the externally extended mold and located directly under an outlet of the externally extended mold, into which a melt remaining in the mold is discharged in cases where a disconnection of the magnesium alloy plate is caused due to an unstable solidification of the magnesium alloy melt in the mold, or where such disconnection occurs during a drawing process attributable to an unstable drawing cycle.

* * * * *